US005462318A

United States Patent [19]

Cooke

[11] Patent Number: 5,462,318

[45] Date of Patent: Oct. 31, 1995

[54] TOGGLE FASTENER

[75] Inventor: Robert S. Cooke, Broomfield Cottage, Great Britain

[73] Assignee: Protex Fasteners Limited, Hereford & Worcester, United Kingdom

[21] Appl. No.: 206,868

[22] Filed: Mar. 4, 1994

[30] Foreign Application Priority Data

Mar. 27, 1993 [GB] United Kingdom ..... 93106441

[51] Int. Cl.[6] ..... E05C 3/06

[52] U.S. Cl. ..... 292/200; 292/113

[58] Field of Search ..... 292/113, 200, 292/247, DIG. 49, 205, DIG. 73, DIG. 42

[56] References Cited

U.S. PATENT DOCUMENTS

| | | | |
|---|---|---|---|
| 4,053,177 | 10/1977 | Stammreich et al. | 292/113 |
| 4,183,564 | 1/1980 | Poe | 292/113 |
| 4,522,436 | 6/1985 | Hoen et al. | 292/113 |
| 4,531,769 | 7/1985 | Glancy | 292/113 |
| 4,705,308 | 11/1987 | Bisbing | 292/113 X |
| 4,743,052 | 5/1988 | Stammreich et al. | 292/113 |
| 4,768,815 | 9/1988 | Harmon | 292/113 |
| 5,131,246 | 7/1992 | Bonzor | 292/113 X |
| 5,165,148 | 11/1992 | Fleischer et al. | 292/113 X |

*Primary Examiner*—Peter M. Cuomo
*Assistant Examiner*—Jerry Redman
*Attorney, Agent, or Firm*—Learman & McCulloch

[57] ABSTRACT

A toggle fastener as a hasp lever 22 pivoted on a first axis on mounting plate 10, and pivotally mounting bail 24 28 on a second axis 30. The bail is to engage in jaw 26 in keeper 14 and when the plate 10, bail 24 and lever 22 are all substantially parallel, which is the secured position of the fastener and lugs 32 provided on the hasp 22 lie closely adjacent to the bail between axis 30 and the axis of the keeper engaged end, and serve to prevent or limit pivotal movement of the bail about either end. This enables the fastener to be used to secure panels in place.

10 Claims, 2 Drawing Sheets

TOGGLE FASTENER

BACKGROUND OF THE INVENTION

A toggle fastener may be defined as one which comprises two components to be fixed on the respective parts namely a mounting plate and a keeper which are to be releasably fastened together. The plate provides a pivotal mounting on a first axis for a hasp lever, and the latter provides a pivotal mounting on a second axis for a bail, claw or other component (herein called 'bail') which is apt to engage with the keeper. The first axis lies between the keeper and the second axis when the fastener is engaged. In the engaged position, a line of engagement between the keeper and bail may be generally co-planar with the first and second axes, but usually the design is such that the second axis crosses a plane containing the said line of engagement and the first axis during the final stage of a fastener closing movement and this 'overcenter' movement provides a security of fastening, that is holds the fastener in the closed position against inadvertent release. Additional security means may be provided for example in the form of a catch which has to be moved against a spring before the hasp can be returned overcenter to release the bail, or in the form of a lug which extends through a movable part and is apertured to take a padlock or seal. A toggle fastener as defined in the foregoing words (with or without the additional security means) is conveniently called "of the kind referred to" and represents the starting point of the present invention.

The problem with fasteners of the kind referred to is that in the engaged position one or other end of the bail may act as a hinge and allow relative movement of the parts which are secured. Thus for example a panel fixed by toggle fasteners on opposite edges may vibrate with the respective bails acting as swinging links. Simple toggle fasteners are not recommended for this kind of use for this reason, although they are often so used and are maligned when they do not perform as expected.

The object of the invention is to solve this problem.

SUMMARY OF THE INVENTION

According to the invention, a toggle fastener of the kind referred to is provided with means for preventing pivotal movement of the bail on the hasp in at least one direction, independent of the overcenter action, and when the fastener is in a secured position.

In one possibility, the pivoting is prevented by the provision of projections on the hasp which can engage the bail between the second axis and the keeper after conclusion of the overcenter action in closing.

In another possibility, a projection on the mounting plate is arranged to abut the bail preferably in the region of the keeper. However, in both possibilities, the 'engagement' may involve a tolerance to allow a limited amount of movement. This may enable the fastener of the invention to be used to pull a part down against a compressible seal, and to allow the seal to recover slightly re-establishing a small clearance.

THE DRAWINGS

The invention is now more particularly described with reference to the accompanying drawings wherein.

DETAILED DESCRIPTION

Figure 1:
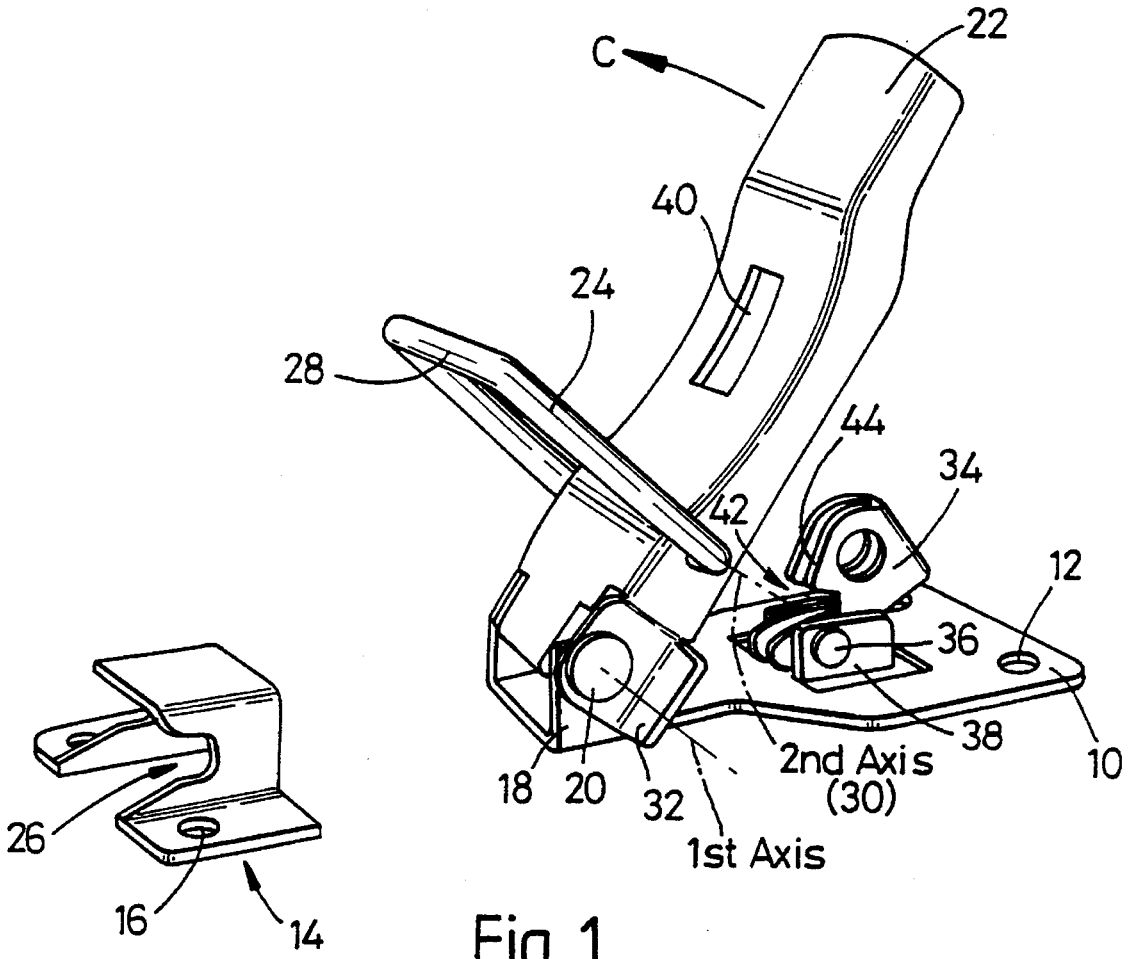
FIG. 1 is a perspective view of a first embodiment of the invention, in an open position.

Turning first to FIG. 1, a fastener comprises a mounting plate 10 having holes 12 for example for screw attachment to a first part, and a keeper 14 likewise pierced at 16 for attachment to a second part. As shown best in FIG. 2, the mounting plate 10 and keeper 14 have generally flat, planer mounting surfaces 11 and 15, respectively, for mounting on adjacent support structure (not shown) which, when the fastener is in a secured position as shown, are generally coplaner.

The plate 10 has lugs 18 bent up and co-axially pierced to receive pin 20 lying on the first axis.

Hasp lever 22 is of hollow box-like construction being hinged at one end on the first axis, and extending therefrom to an opposite free end. The hasp lever 22 has co-axial apertures to journal one end of a bail 24 for rotation about a second axis 30 that extends therefrom to an opposite free end that is swingable along an arc about the second axis toward and away from the mounting plate 10. In this embodiment the bail is a wire loop, but in other embodiments (not further described herein) it may be of construction similar to the hasp. The hasp is provided with lateral lugs 32 adjacent the axis 20 and located as far away from the axis 30 as possible in the direction towards the keeper, for the purposes of the invention as further described herein.

Keeper 14 has jaws 26 to receive the end part 28 of the bail.

Figure 2:
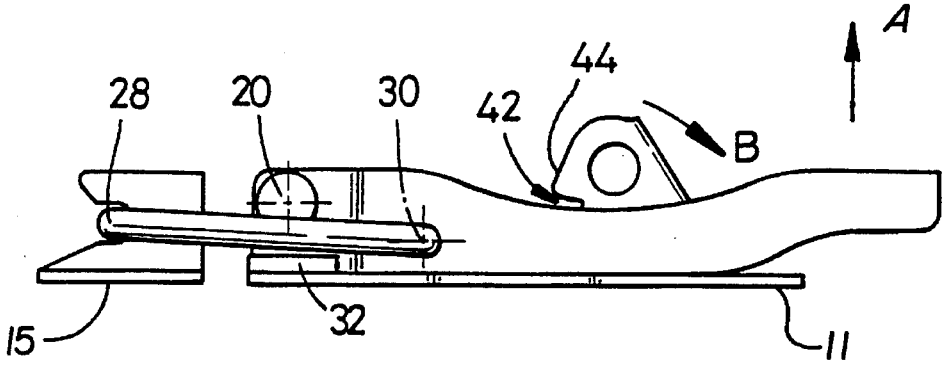
FIG. 2 is a side elevation of the same in the closed engaged position.

The bail 24 is engaged in the jaw 26, if necessary by pivoting the hasp in the direction of the arrow C in FIG. 1. The hasp is then returned and moved to the FIG. 2 secured position and this draws the parts (i.e., the keeper and mounting plate) together, and after the first and second axes together with the axis of the bail part 28 pass the co-planar position, and go overcenter, the position of FIG. 2 is realized. Thus, movement of the hasp lever 22 in the direction of arrow B brings the bail 24 into generally coplaner relation with the first and second axes and preferably, as shown, to an over center position just beyond true coplaner to hold the fastener in the secured position. Although the slight overcentre movement normally holds the parts securely engaged, additional catch means may be provided as illustrated, in this case in the form of spring loaded catch 34 pivoted on pin 36 between lugs 38 struck out of the mounting plate and disposed so as to project through slot 40 in the hasp. The catch has a jaw 42 to engage in end edge of the slot and a cam edge 44. The catch automatically engages by virtue of a trapped spring when the hasp is moved to the FIG. 2 position, and can be released to allow release of the fastener by displacing the catch in the direction of the arrow B in FIG. 2.

In the engaged position, if the part or support structure to which plate 10 is fixed attempts to move in the direction of the arrow A in FIG. 2 relative to the part or support structure to which the keeper 14 is fixed, it can only do so by pivoting about one or other end of the bail, i.e. about the axis 30 or the axis of the part 28. In either case the pivoting is prevented when the fastener is in the secured position by means of a bail stop such as the lugs 32 carried by the hasp lever 22 on opposite sides thereof and extending laterally outwardly of the hasp lever 22 into the path of movement of the bail 24 thereby to confront the bail 24, possibly after a clearance has been taken up, to retain the bail and the fastener in the secured position in opposition to counteractive external forces applied to the fastener. The clearance shown is or may be exaggerated in FIG. 2 for clarity. It will be seen that in the absence of lugs 32 the bail could act as a swinging link to allow such movement of the fastener out of the secured position.

Figure 3:
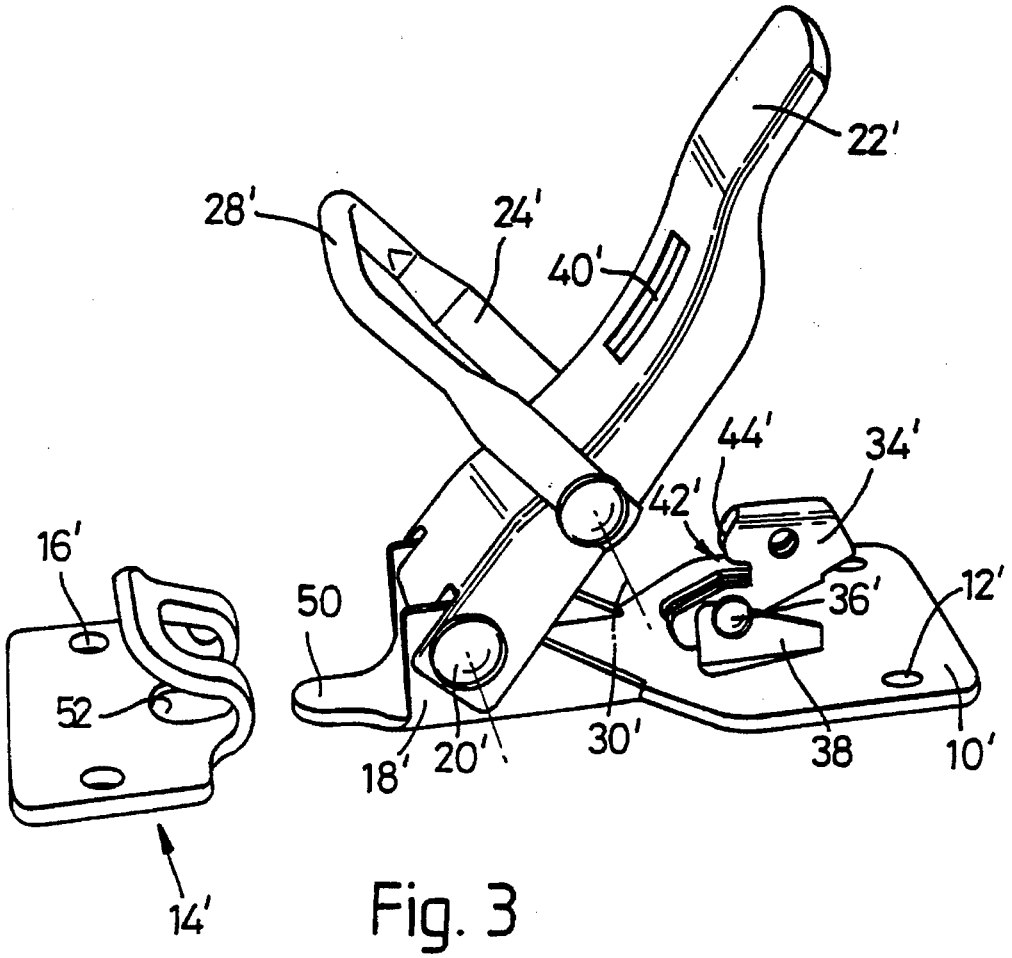
FIGS. 3 and 4 are views similar to FIGS. 1 and 2 but of a second embodiment.
Figure 4:
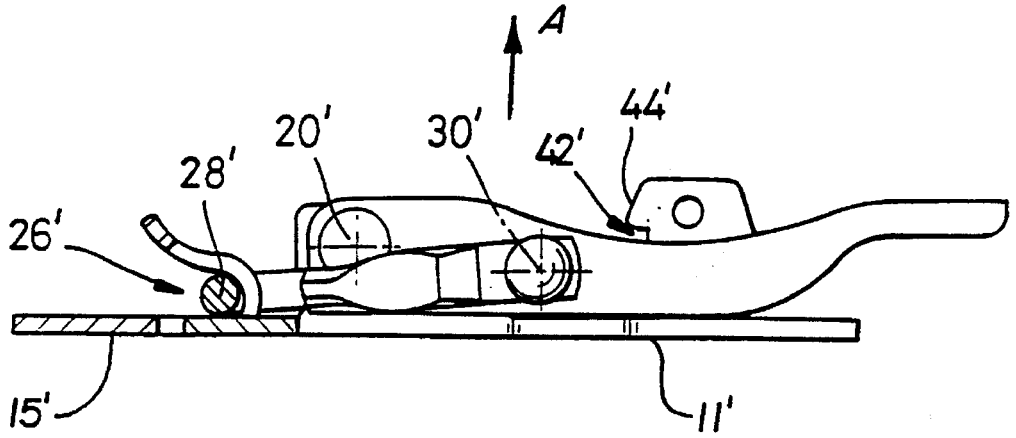

Turning now to FIGS. 3 and 4, a second embodiment of the mounting plate 10' is shown provided with a projection 50 extending longitudinally from an end of the mounting plate 10' toward the keeper 14' and shaped to be received in a recess 52 in the keeper 14'. In the engaged position of the fastener, the projection 50 is received in the recess 52, and may be a relatively close fit therein. As best seen in FIG. 4, the projection 50 underlies the bail part 28' in the jaw 26' and hence positively prevents any movement of the mounting plate 10' and the associated parts in the direction of the arrow A in FIG. 4. Other parts of FIGS. 3 and 4 having the same function as those in FIGS. 1 and 2 are identified by corresponding primed reference numerals.

I claim:

1. A toggle fastener comprising a first mounting plate, a hasp lever; and a bail having two ends, said hasp lever having a first end pivotally connected to said first mounting plate for rotation about a first axis, said bail having one end pivotally connected to said hasp for rotation about a second axis, said second axis lying between said first end of said hasp lever and its opposite end; a keeper separate from said mounting plate having means engageable with the second end of said bail; said opposite end of said hasp lever being arcuately movable about said first axis and in a direction toward said first mounting plate so that engagement of said bail by said keeper together with said arcuate movement of said hasp lever toward said mounting plate acts to draw said keeper and mounting plate together into a secured position and bring said bail at least into a common plane with said first and second axes; and abutment means positioned to confront said bail when in said secured position for preventing movement of said bail relative to said hasp lever in a direction toward said mounting plate and about said second axis for retaining said mounting plate, said keeper and said bail in said secured position in opposition to an external force applied to said fastener to urge said bail toward movement in said at least one direction.

2. A toggle fastener as set forth in claim 1 wherein said abutment means comprises at least one lateral projection on said hasp lever so that when said fastener is moved to said secured position said projection confronts said bail between said ends of the bail to prevent movement of the bail.

3. A toggle fastener as set forth in claim 2 wherein said abutment means comprises a pair of oppositely extending lateral projections carried by said hasp lever adjacent said mounting plate when said fastener is in said secured position.

4. A toggle fastener as set forth in claim 2 wherein said abutment means comprises a projection provided on said mounting plate and so positioned as to abut said bail when said fastener is in said secured position.

5. A toggle fastener as claimed in claim 4 wherein said projection extends from an end of said mounting plate toward said keeper, and is received in a recess of said keeper when said fastener is in said secured position to provide lateral registry of said mounting plate and said keeper.

6. A toggle fastener as claimed in claim 5 wherein said free end of said bail comprises a transversely extending portion and said projection is arranged to underlie and confront said transversely extending portion when said fastener is in said secured position.

7. A toggle fastener device comprising:

a mounting plate having a planer mounting surface adapted to be mounted on a first support structure;

a hasp lever having one end pivoted to said mounting plate for rotary movement about a first axis and extending therefrom to an opposite end;

a bail having one end pivoted to said lever for rotary movement about a second axis and extending therefrom to an opposite free end that is rockable about said second axis along a curved path in a direction toward and away from said mounting plate, said second axis being spaced from said first axis and located between said ends of said lever;

a keeper separate from said mounting plate having a planer mounting surface adapted to be mounted on a second support structure and means for releasably engaging said free end of said bail, said hasp and said bail being movable conjointly to a secured position in which said bail is engaged with said keeper and said mounting surface of said mounting plate is arranged in substantially coplaner alignment with said mounting surface of said keeper;

and a bail stop so positioned along said path of movement of said bail as to limit said movement of said bail in said direction toward said mounting plate substantially beyond said secured position of said bail thereby to retain said mounting surfaces of said keeper and said mounting plate in said substantial coplaner alignment in opposition to an applied external force on said fastener that acts to urge said mounting plate and said keeper out of said substantial coplaner alignment and said bail to move substantially beyond said secured position.

8. The fastener of claim 7 wherein said bail stop comprises a pair of projections extending laterally outwardly from opposite sides of said hasp in a position to engage said bail when said bail is moved to said secured position.

9. The fastener of claim 7 wherein said bail stop comprises a projection on said mounting plate extending longitudinally beyond said free end of said bail adjacent said keeper in a position to abut said bail when said bail is moved to said secured position.

10. A toggle fastener comprising: a mounting plate; a keeper; a hasp lever pivoted to said mounting plate on a first axis near said keeper; and a bail having one end pivoted to said hasp lever on a second axis more remote from said keeper than said first axis and a second end for engagement with said keeper, said hasp lever having a pair of oppositely extending lateral projections so located as to be in close juxtaposition to the plane of said mounting plate when said fastener is in a secured position and positioned to confront said bail when said fastener is in said secured position to prevent pivotal movement of said bail in at least one direction about said first axis.

* * * * *